US005617591A

United States Patent [19]

Bloemer et al.

[11] Patent Number: 5,617,591

[45] Date of Patent: Apr. 8, 1997

[54] HEAD REST ASSEMBLY

[76] Inventors: John M. Bloemer, 1135 Morraine View Dr., Apt. 4, Madison, Wis. 53719; Michael J. Kurth, 1509 Apple Tree Rd., Howards Grove, Wis. 53083; Alan D. Bengtson, 385 Oakwood Ave., Apt. 6, East Aurora, N.Y. 14052; Robert C. Giese, 3050 Georgia Ave., Sheboygan, Wis. 53081; Edwin R. Potter, Jr., 428 N. Lincoln Dr., Howards Grove, Wis. 53083; Thomas A. Bonnell, 121 Lake Ct., Sheboygan, Wis. 53081; Thomas W. Clarke, 3428 N. 6th St., Sheboygan, Wis. 53083

[21] Appl. No.: 619,900

[22] Filed: Mar. 20, 1996

Related U.S. Application Data

[60] Division of Ser. No. 376,575, Jan. 23, 1995, Pat. No. 5,546,616, which is a continuation-in-part of Ser. No. 107, 404, Aug. 16, 1993, Pat. No. 5,548,854.

[51] Int. Cl.[6] ..... A61H 33/04

[52] U.S. Cl. ..... 4/541.6; 239/587.1

[58] Field of Search ..... 4/541.1–541.6; 239/587.1

[56] References Cited

U.S. PATENT DOCUMENTS

| | | | |
|---|---|---|---|
| 1,994,413 | 3/1935 | Webster | 4/184 |
| 2,544,745 | 3/1951 | Ashbaugh et al. | 241/101 |
| 2,964,248 | 12/1960 | O'Brien et al. | 239/544 |
| 3,646,883 | 3/1972 | Provi | 100/53 |
| 3,803,943 | 4/1974 | Woloszyk | 74/612 |
| 4,541,130 | 9/1985 | Calvert et al. | 4/593 |
| 4,630,599 | 12/1986 | Perovick et al. | 128/66 |
| 4,635,619 | 1/1987 | Diamond | 128/39 |
| 4,837,870 | 6/1989 | Wiley | 4/508 |
| 4,860,392 | 8/1989 | Gardenier et al. | 4/542 |
| 4,953,240 | 9/1990 | Gardenier | 4/542 |
| 5,010,605 | 4/1991 | Shiina et al. | 4/542 |
| 5,039,058 | 8/1991 | Boeshart | 249/194 |

OTHER PUBLICATIONS

An Oasis ad entitled "Mystique", dated 1990.

Page 14–2 of a 1994 Kohler Co. catalog showing the Peacekeeper Self–Activated flush system.

*Primary Examiner*—Charles E. Phillips

*Attorney, Agent, or Firm*—Quarles & Brady

[57] ABSTRACT

A head rest assembly is provided for use in conjunction with a bathing fixture such as a hydro-massage whirlpool. A pillow is provided which can be easily connected and supported by the jet nozzle assembly. A support bracket is partially enclosed in the pillow for connection with the nozzle assembly. The nozzle assembly has a living hinge feature which allows adaptation to various curvatures of the tub wall. A magnet can be connected to a bracket and a reed switch is connected to the nozzle assembly which serves as a safety feature.

1 Claim, 6 Drawing Sheets

FIG. 7
4/6
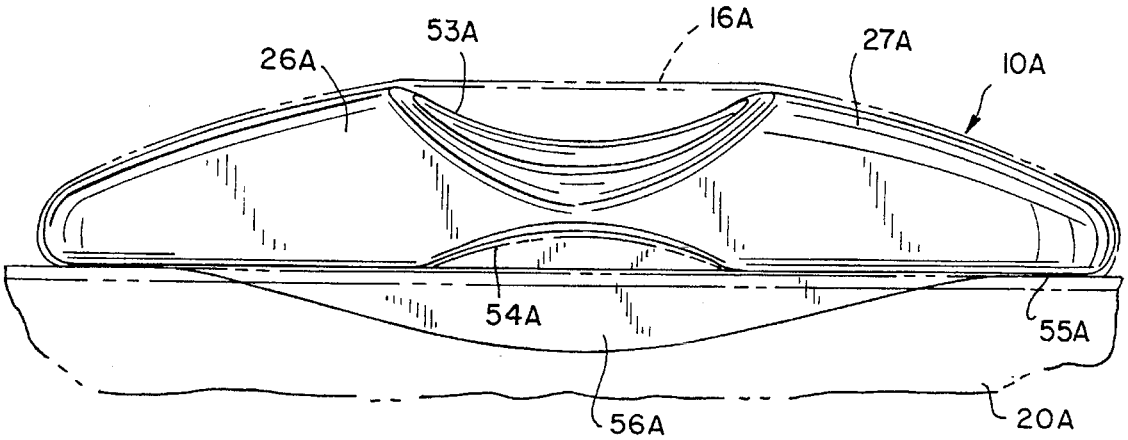
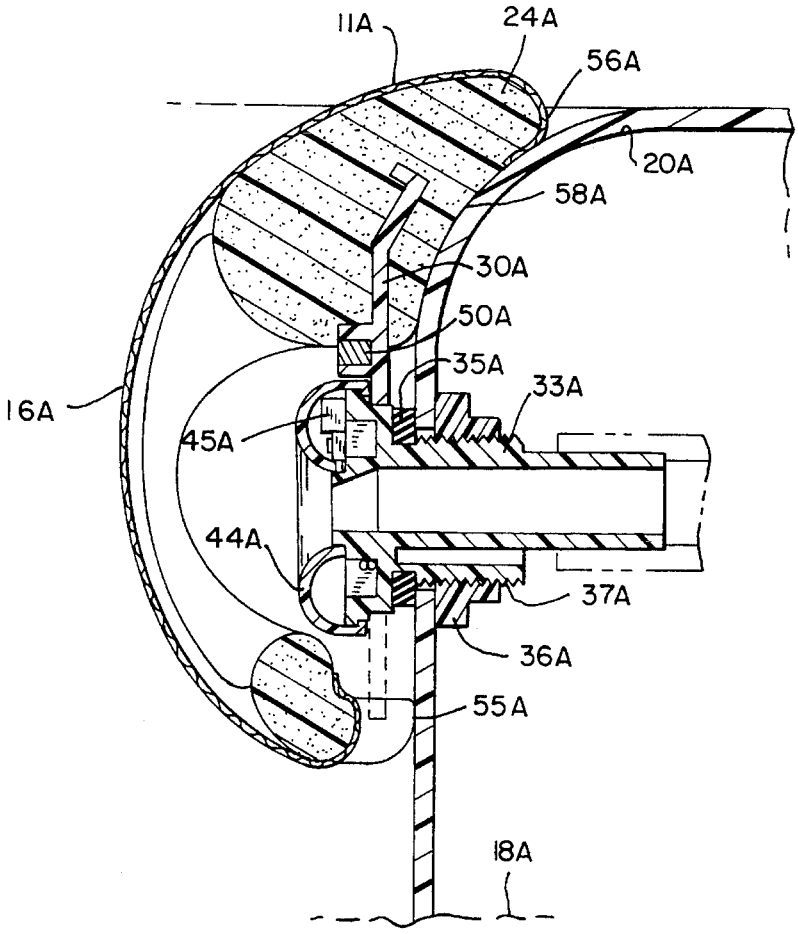
FIG. 8

HEAD REST ASSEMBLY

CROSS-REFERENCE TO RELATED APPLICATIONS

This is a division of application Ser. No. 08/376,575, filed Jan. 23, 1995, now U.S. Pat. No. 5,546,616 which is a continuation-in-part of U.S. patent application Ser. No. 08/107,404 filed Aug. 16, 1993 entitled "Hydro Massage Tub Control System", now U.S. Pat. No. 5,548,854.

BACKGROUND OF THE INVENTION

A. Field Of The Invention

The present invention relates primarily to bathing fixtures such as hydro-massage spas and whirlpools. More particularly, it relates to a head rest member for use with such bathing fixtures.

B. Description Of The Art

It is known to provide head rest members in bathing fixtures. U.S. Pat. No. 4,860,392 shows the flow of a fluid stream against a flexible material to effect a massaging action as do U.S. Pat. Nos. 4,635,619 and 4,953,240. See also U.S. Pat. No. 5,010,605.

Although the prior art teaches various types of body support or neck massage devices for use with bathing fixtures, there is not available a head support member which can be easily secured to the bathing fixture in conjunction with body spray nozzles. Neither is there available a spray nozzle assembly which includes signalling means so as to prevent the flow of water to the head support unless the head support is properly positioned on the nozzle assembly. In addition, the prior art does not provide a spray nozzle assembly which is particularly suited for connection with a head support member, as well as can conform to various wall surfaces of the bathing fixture. Further, the prior art does not afford a connection between a head rest member and a nozzle assembly which is adaptable to various configurations of head rest members or pillows. Thus a need exists for an improved head support and nozzle assembly for use in conjunction with a hydro-massage spa or whirlpool.

SUMMARY OF THE INVENTION

In one aspect, the invention provides a head rest assembly for use in conjunction with a bathing fixture. A body member has a section to support a head. A fluid inlet nozzle provides fluid to the body member. A support bracket is connected to the body member and the nozzles. There are signalling means provided on the body member to signal when the body member is positioned to cover the nozzle.

In another aspect, the signalling means is a magnet, and a reed switch is positioned on the bracket to signal the proximity of the magnet.

In still another aspect, the support bracket is connected to the nozzle assembly, and the nozzle assembly includes at least two nozzle portions interconnected by a living hinge.

In one embodiment, the body member defines a pillow which is essentially horseshoe shaped in frontal view.

In another embodiment, the body member defines a pillow and is essentially elongated and curved and includes two centrally disposed opposing concave surfaces.

In yet another embodiment, the support bracket is connected to the nozzle assembly by an inner portion extending from the bracket for reception in a groove on the nozzle assembly.

In a preferred embodiment, there are two fluid inlet nozzles for providing fluid to the body member, and a living hinge interconnects the nozzles.

In still another preferred embodiment, there is a cover for the pillow which affords functional and aesthetic purposes.

The objects of the invention therefore include:

a. providing a head rest assembly for a bathing fixture which is easily connected to the fixture;

b. providing a head rest assembly of the foregoing type which is easily connected to the nozzle members of a hydro-massage spa or whirlpool;

c. providing a head rest assembly in the form of a pillow which is readily connected to a hydro-massage spa or whirlpool;

d. providing a head rest assembly for a hydro-massage spa or whirlpool in the form of pillows which can be of various shapes and sizes;

e. providing a head rest assembly of the foregoing type which has a magnet disposed thereon for activating a switch on a nozzle jet; and f. providing a cover for the pillows which can dampen the force of water from the nozzle members, as well as afford a decorative effect.

These and still other objects and advantages of the invention will be apparent from the description which follows. In the detailed description below, the preferred embodiments of the invention will be described in reference to the accompanying drawings. These embodiments do not represent the full scope of the invention. Rather the invention may be employed in other embodiments. Reference should therefore be made to the claims herein for interpreting the breadth of the invention.

BRIEF DESCRIPTION OF THE DRAWINGS

FIG. 7 is a bottom view taken along line 7—7 of FIG. 6;

FIG. 8 is a sectional view taken along line 8—8 of FIG. 6;

DESCRIPTION OF THE PREFERRED EMBODIMENTS

Figure 1:
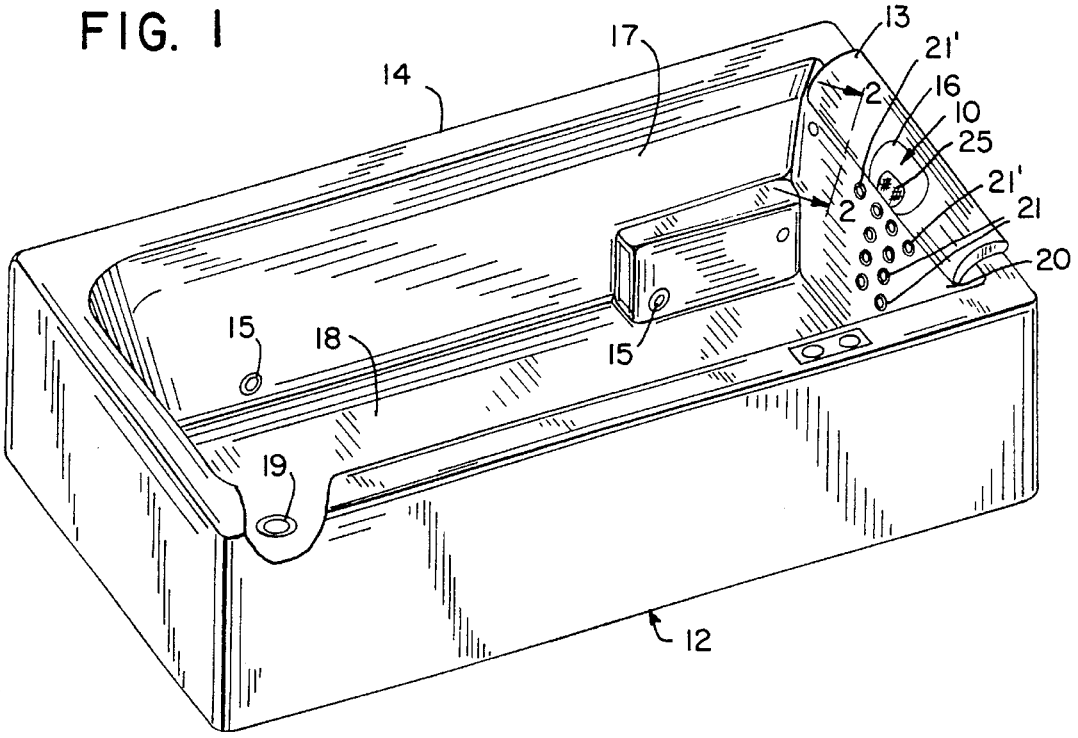
FIG. 1 is a top perspective view of a whirlpool tub which incorporates the present head rest assembly.
Figure 2:
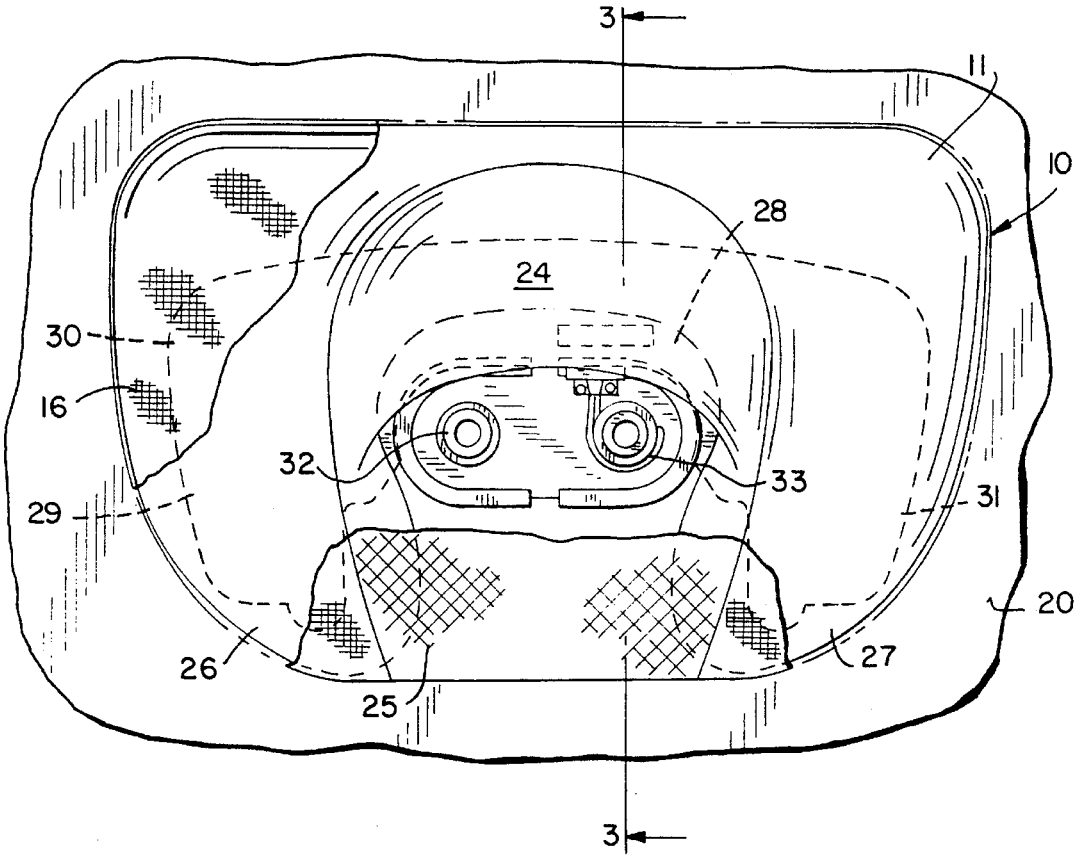
FIG. 2 is a sectional view taken along line 2—2 of FIG. 1.

Referring specifically to FIGS. 1 and 2, the head rest assembly, generally 10, is employed in conjunction with a hydro-massage whirlpool, generally 12, which includes a tub 14 having a plurality of conventional whirlpool nozzles 15 projecting through an interior side wall such as 17. The tub has the usual floor 18 with a standard drain opening 19.

A soft cushion 13 is attached to the rim of the tub above end wall 20 with the head rest assembly 10 positioned centrally therein. Also positioned in end wall 20 are nozzles 21 which are arranged in pairs except for the outer two nozzles 21'. These nozzles preferably are provided by the whirlpool jet manifold described in U.S. patent application entitled "WHIRLPOOL JET MANIFOLD" Ser. No. 8/352,667 filed Dec. 9, 1994 which is commonly assigned.

Figure 3:
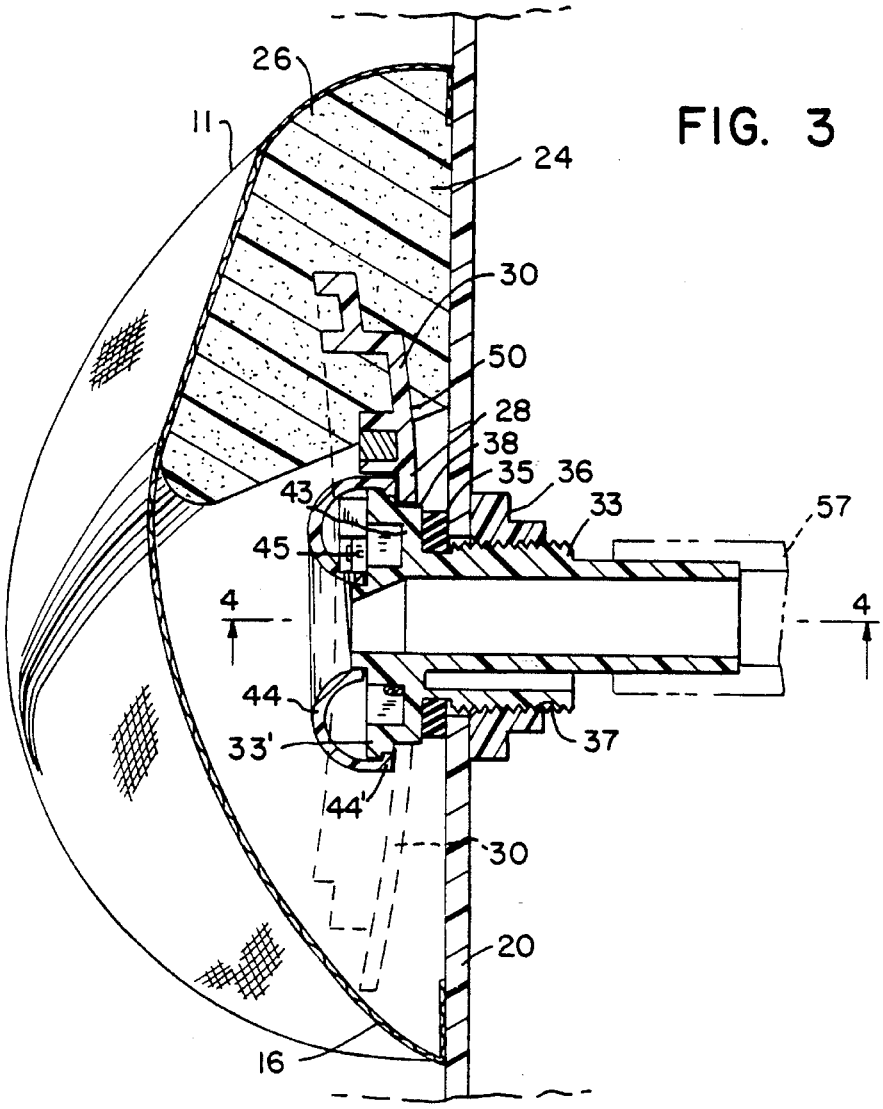
FIG. 3 is a sectional view taken along line 3—3 of FIG. 2.

Referring to FIGS. 2 and 3, the head rest assembly 10 includes a pillow 11 having a generally C-shaped configuration with a central section 24 and two leg sections 26 and 27. The pillow is preferably composed of a self-skinning urethane foam and has a fine mesh, fabric cover 16 extending thereover. The primary purpose of the fabric cover is to provide a dampening or softening of the force of the water jet stream from nozzles 32 and 33 so that the water will not project beyond the bathing well while allowing water to pass therethrough. A drain net 25 is connected to cover 16 for placement between the leg sections 26 and 27 and extending from central section 24. This provides a drainage of the water from the pillow. The pillow is preferably molded around a bracket 30 composed of polypropylene. The bracket 30 also has a central section 28 and two leg sections 29 and 31 which surround the nozzles 32 and 33. It is attached to the nozzles 32 and 33 in a manner explained later in detail in conjunction with FIGS. 9–12.

As seen in FIG. 3, the nozzles such as 33 are held in place and connected to the tub wall 20 by the nut 36 and the washer 35 with a threaded connection 37 provided between the nozzle 33 and the nut 36. Water is supplied to the nozzle such as through the usual conduit 57. A magnet 50 is housed in the bracket. 30 and is utilized to activate a reed switch 45. A support surface 38 for the bracket 30 is provided by the nozzle body 43. A nozzle cover 44 is connected to nozzle 33 such as by the hooked portion 44' engaging flanged portion 33' of nozzle 33.

Figure 4:
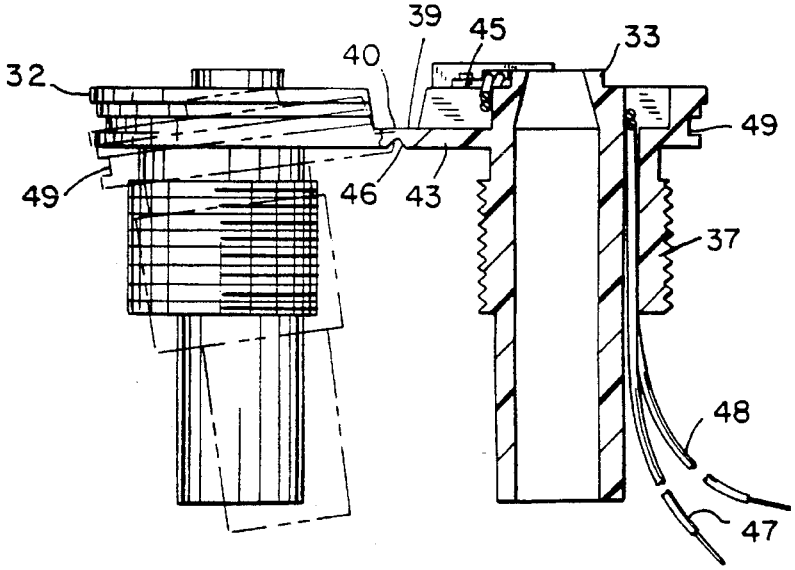
FIG. 4 is a sectional view taken along line 4—4 of FIG. 3.
Figure 5:
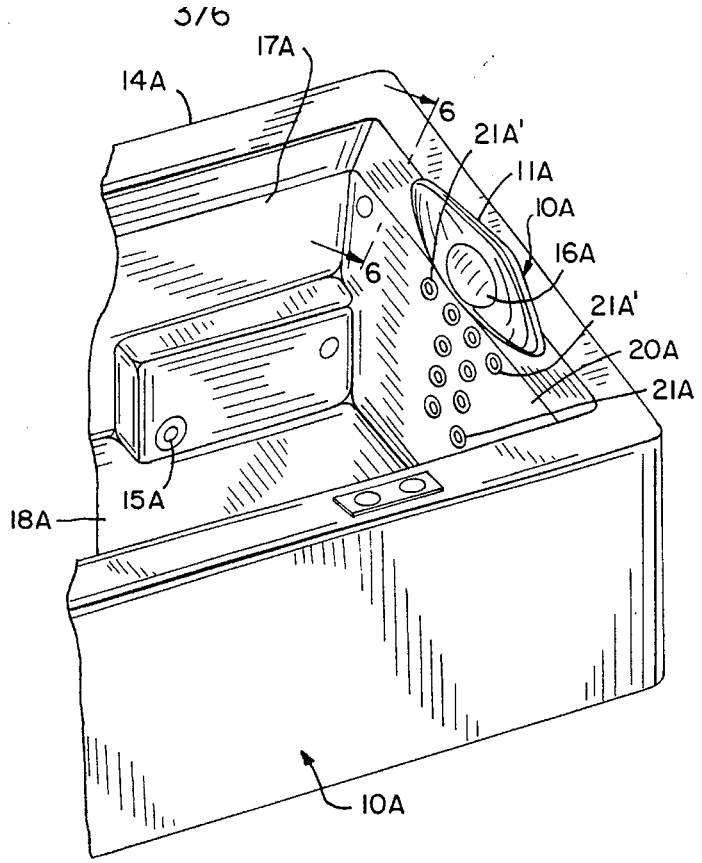
FIG. 5 is a partial perspective view similar to FIG. 1 showing an alternative embodiment.

As shown in FIG. 4, the reed switch 45 is connected to the electrical lines 47 and 48. This permits activation of a pumping apparatus (not shown) when the pillow 11 is in place. As also seen in FIG. 4, the nozzles 32 and 33 are joined by a central body section 39 of nozzle body 43 having a living hinge 40 provided by cutout 46. The nozzles 32 and 33, as well as the central body section 39, are molded from a semi-rigid plastic material. The living hinge 40 allows a hinging action between the two nozzles 32 and 33 so as to facilitate connection to a curved wall of a tub. A peripheral groove 49 is provided for connection with the bracket 30.

FIGS. 5–10 show an alternative embodiment. Similar numbers refer to the same or similar components as described with embodiment 10 except they are designated with the suffix "A". The major difference between the two embodiments is that embodiment 10A includes a different pillow design having the central concave portions 53A and 54A and an oval shaped body 23A. This is seen in FIG. 7. Further, another difference is a lip portion 56A which extends from the back of pillow 10A and over the top of the tub 14A. This is utilized to cover the side wall of the tub 14A where it is curved. In many instances, the tub 14A will not have a major curvature and consequently the lip can be eliminated. In addition, and as seen in FIG. 8, it is noted that the pillow 11A has a curved wall section 58A to accommodate the upper curved wall 20A of the tub, as well as a lower flat edge portion 55A.

It is seen that embodiment 10A does not have the drain net 25 in conjunction with the cover 16A. Drainage is afforded instead by a concave portion 54A extending along the backside of pillow 11A between the leg portions 26A and 27A.

Although not shown in the drawings, a pillow in the general shape of a boomerang can be used. It would not have the drain net 25 or concave portion 54. Instead a recessed channel would be present in the back of the pillow which serves the same drainage result.

Figure 9:
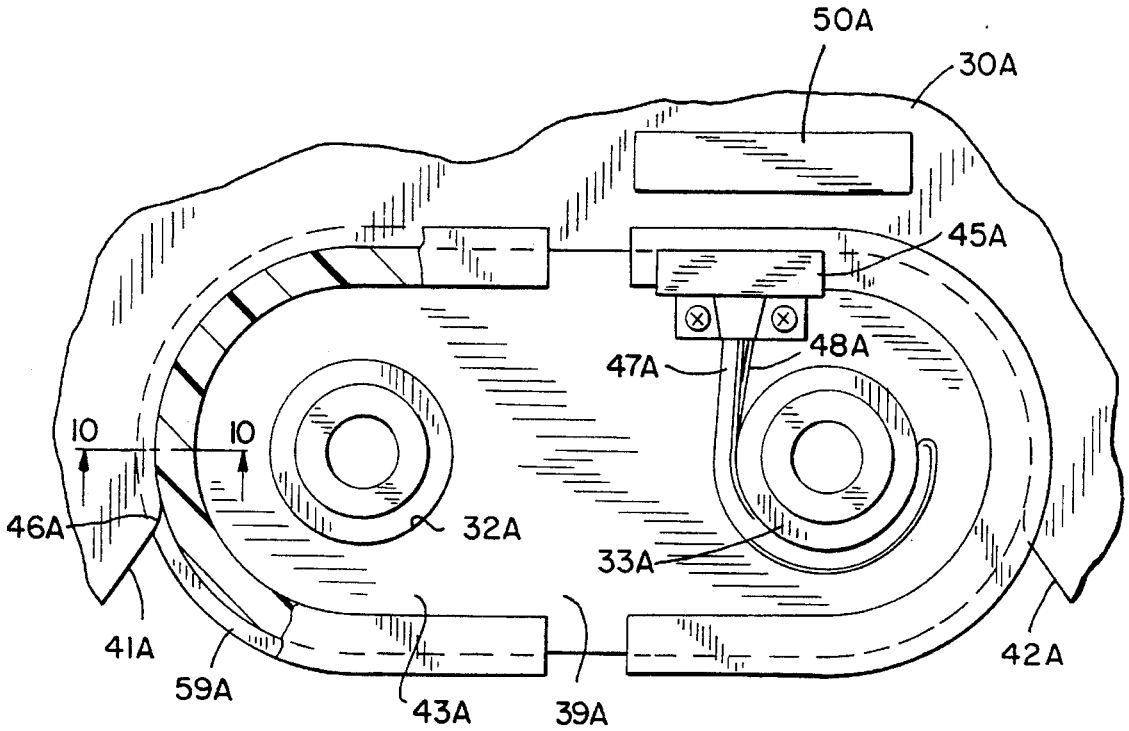
FIG. 9 is a view in side elevation (with partial showing) illustrating the head rest assembly connected to nozzles.
Figure 10:
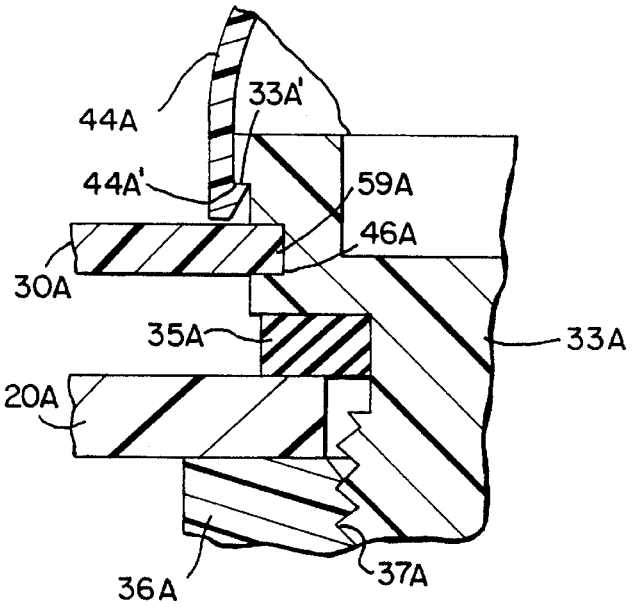
FIG. 10 is a partial sectional view taken along line 10—10 of FIG. 9.
Figure 11:
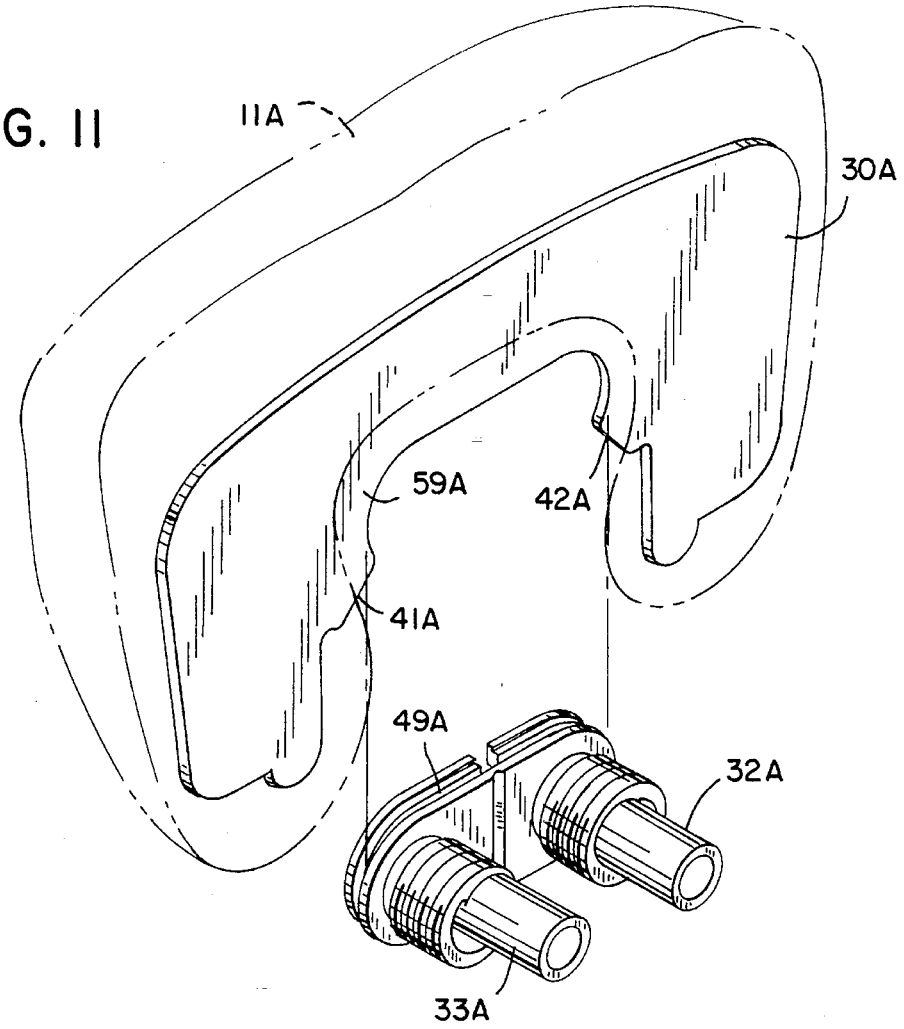
FIG. 11 is an exploded view of the head rest assembly and nozzle members shown in FIG. 6.

FIGS. 9, 10 and 11 show the attachment of the pillow bracket 30A to the nozzles 32A and 33A. A peripheral groove 49A extends around the nozzles 32A and 33A. It receives an inner edge portion 59A of the bracket 30A which terminates in the tabs 41A and 42A and results in the connection shown in FIGS. 6 and 8.

Figure 12:
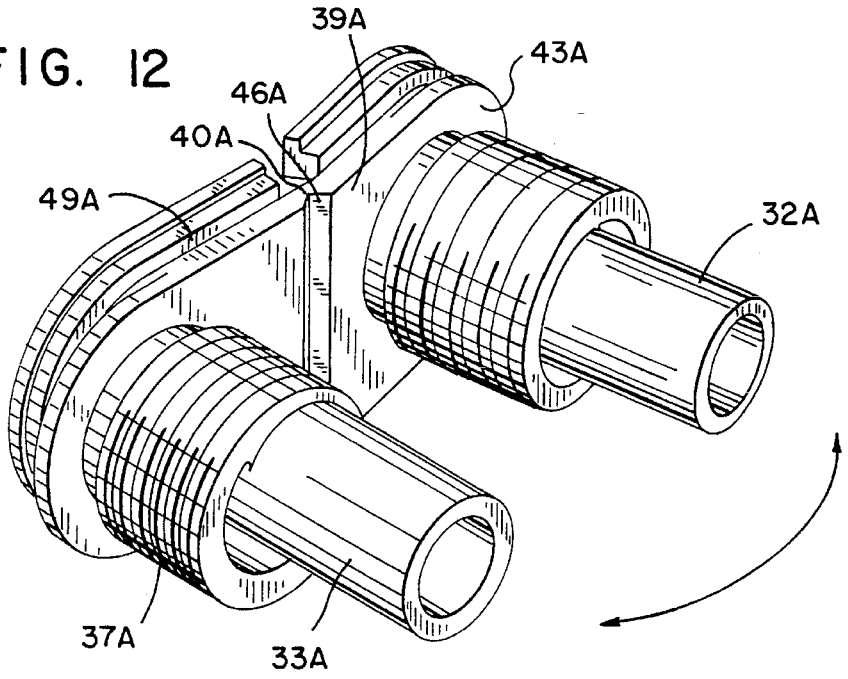
FIG. 12 is a top perspective view of the nozzle members shown in FIG. 11.

FIG. 12 shows in further detail the living hinge 40A as provided by the cutout 46A in the central section 39A of the nozzle body 43A.

Figure 6:
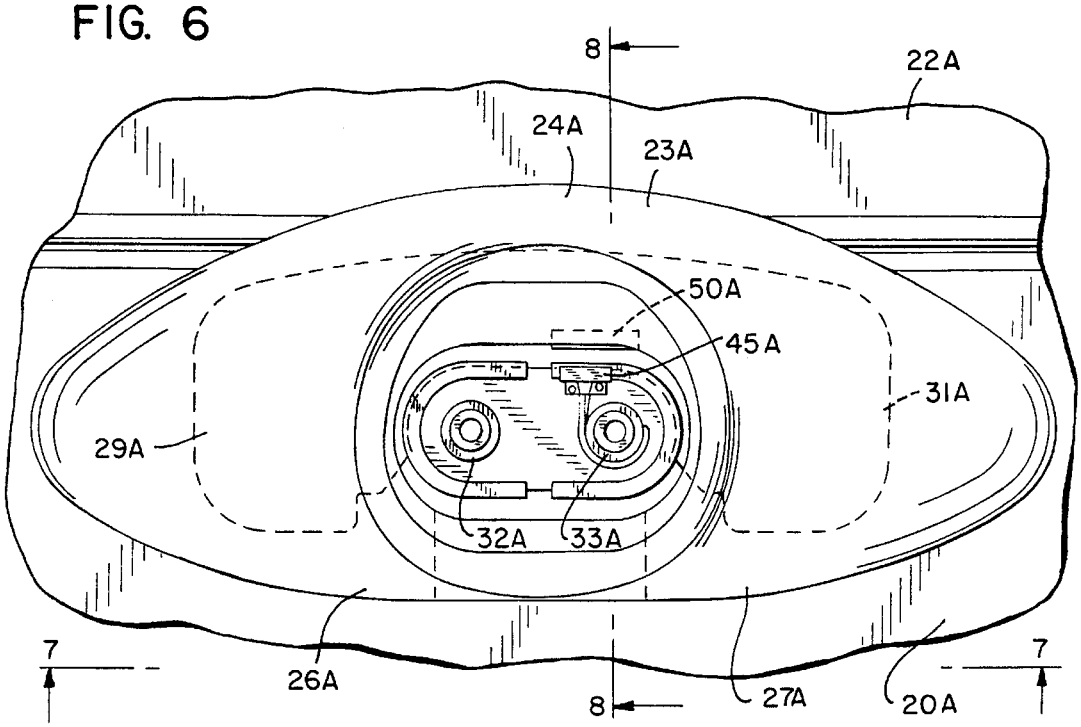
FIG. 6 is a sectional view taken along line 6—6 of FIG. 5.

Referring specifically to FIG. 6, the pillow 11A is shown as extending from end wall 20A with a portion extending over top rim 22A. It is not used with the cushion 13 shown in FIG. 1. If desired, it can be incorporated into a cushion or another pillow such as 13 with the cushion being cut out to conform to the oval shape of pillow 11A.

Thus, the invention provides an improved head rest member for use in conjunction with a hydro-massage whirlpool. A pillow is provided as a head rest member which is easily attached and supported by the neck massage nozzles. The pillow can be of various designs to complement the configuration of the wall of the whirlpool. It also has a cover which can be decorated with various aesthetic designs and colors. In addition, a unique nozzle unit is provided having a living hinge which can accommodate the wall configurations of the whirlpool.

Further, the attachment of the pillow to the jet nozzles also affords the use of an electrical safety device in conjunction with the magnet and the reed switch so that the jets cannot be activated without placement of the pillow.

While the use of the safety device is advantageous, it should be appreciated that the attachment of the pillow to the jet nozzles and its advantages are accomplished without the use of the magnet and the switch. Further, while the living hinge aspect of the nozzles has advantages, the pillow connection is also effected without it. As previously indicated, the pillow can be of various configurations and incorporated in a cushion, or it can also be utilized without it. Certain materials have been utilized in composing different elements of the pillow, the bracket and the nozzle. Obviously, other materials can be advantageously employed. All such and other modifications within the spirit of the invention are meant to be within the scope of the invention.

We claim:

1. A head rest assembly for use in conjunction with a bathing fixture comprising:

a body member including a section to support a head; a nozzle body having two fluid inlet nozzles for providing fluid to the body member;

a living hinge on said nozzle body interconnecting said nozzles; and a support bracket on said body member for attaching said nozzle body to said body member.

* * * * *